US007524049B2

(12) United States Patent
Nakashima

(10) Patent No.: US 7,524,049 B2
(45) Date of Patent: Apr. 28, 2009

(54) RECORDING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 495 days.

(21) Appl. No.: 11/277,498

(22) Filed: Mar. 25, 2006

(65) Prior Publication Data

US 2006/0221164 A1 Oct. 5, 2006

(30) Foreign Application Priority Data

Mar. 30, 2005 (JP) ..... 2005-100006

(51) Int. Cl.
*B41J 2/01* (2006.01)
*B41J 29/38* (2006.01)

(52) U.S. Cl. ..... 347/104; 347/101; 347/14

(58) Field of Classification Search ..... 347/104, 347/101, 9, 14, 16, 19
See application file for complete search history.

(56) References Cited

U.S. PATENT DOCUMENTS

| | | | | |
|---|---|---|---|---|
| 4,418,773 | A * | 12/1983 | Finet et al. | 177/16 |
| 4,697,944 | A * | 10/1987 | Peebles et al. | 400/635 |
| 5,662,322 | A * | 9/1997 | Kawaguti | 271/84 |
| 6,336,019 | B2 * | 1/2002 | Castelli et al. | 399/162 |
| 6,842,602 | B2 * | 1/2005 | Kudo | 399/303 |
| 7,134,736 | B2 * | 11/2006 | Merz et al. | 347/5 |
| 2002/0018097 | A1 * | 2/2002 | Kitahara et al. | 347/42 |
| 2003/0160851 | A1 * | 8/2003 | Baccay et al. | 347/101 |
| 2005/0105937 | A1 * | 5/2005 | Sakai | 399/301 |
| 2005/0214035 | A1 * | 9/2005 | Kamiya | 399/301 |

FOREIGN PATENT DOCUMENTS

| | | | |
|---|---|---|---|
| EP | 782921 | A1 * | 7/1997 |
| JP | 02175539 | A * | 7/1990 |
| JP | H5297737 | | 11/1993 |
| JP | 200019860 | | 1/2000 |
| JP | 200417505 | | 1/2004 |
| JP | 200499248 | | 4/2004 |

* cited by examiner

*Primary Examiner*—Stephen D Meier
*Assistant Examiner*—Leonard S Liang
(74) *Attorney, Agent, or Firm*—Baker Botts L.L.P.

(57) ABSTRACT

There is disclosed a recording apparatus including: feeder rollers including a drive roller; an endless feeder belt wound around the feeder rollers to be circulated around the feeder rollers by operation of the drive roller such that a path of circulation of the feeder belt includes a feeder-belt straight travel zone at which the feeder belt travels straight, the feeder belt feeding a recording medium; a plurality of detection rollers; an endless detection belt formed separately from the feeder belt and wound around the detection rollers such that the detection belt is circulated with the feeder belt by contacting the circulated feeder belt at at least a part of the feeder-belt straight travel zone which part constitutes an overlapping zone, the detection belt having detection marks arranged at constant intervals along an extending direction of the detection belt; at least one pair of nip rollers, each pair cooperating with each other to nip the feeder and detection belts together, at at least a part of the overlapping zone; a detecting device detecting the marks; and a recording portion recording an image on the recording medium as fed by the feeder belt, according to a result of the detection by the detecting device.

12 Claims, 10 Drawing Sheets

RECORDING APPARATUS

INCORPORATION BY REFERENCE

The present application is based on Japanese Patent Application No. 2005-100006, filed on Mar. 30, 2005, the content of which is incorporated herein by reference.

BACKGROUND OF THE INVENTION

1. Field of the Invention

The present invention relates to a recording apparatus that is capable of detecting a traveling speed of a feeder belt with high accuracy, and thus capable of recording an image of high quality.

2. Description of Related Art

As a kind of recording apparatus for recording an image on a recording medium, there is known an inkjet recording apparatus that records an image on a recording medium by transporting or feeding the recording medium by circulating an endless feeder belt, and ejecting droplets of ink from a recording portion onto the recording medium as being fed by the feeder belt.

In a recording apparatus such as the inkjet recording apparatus where recording on a recording medium is performed while a feeder belt transports or feeds the recording medium, a traveling speed of the feeder belt (that corresponds to a speed at which the recording medium is fed, which will be referred to as "the feeding speed of the recording medium" or the like) fluctuates, although the traveling speed of the feeder belt is desired to be constant. This results in an inconvenience that the position at which an image is recorded on a recording medium (which will be hereinafter referred to as "recording position") deviates from a desired position.

Thus, there have been proposed various techniques to control the recording position by detecting a traveling speed of a feeder belt and making an adjustment depending on the detected traveling speed. For instance, JP-A-2004-17505 (see especially paragraphs 0010, 0011, and FIGS. 3 and 4) discloses a method of detecting a traveling speed of a feeder belt, in which one of two opposite edge portions of the feeder belt constitutes a scale portion in which slits are arranged at equal intervals, and an encoder is disposed in order to read the slits to detect the traveling speed of the feeder belt.

However, when the traveling speed of the feeder belt is detected by the technique disclosed in the above-mentioned publication, the feeder belt is bent and stretched at a zone in its circulation path, causing deformation of the slits. When the thus deformed slits are read by an encoder sensor, the obtained traveling speed of the feeder belt is not accurate.

In order to prevent such deformation of the slits, the present applicant has implemented a method such that an endless detection belt less stretchable than a feeder belt and having slits is fixed to the feeder belt at one of opposite edges thereof. However, according to this method, the detection belt does not stretch at a zone where the feeder belt and the detection belt travel together in a bent state, resulting in that the detection belt comes off the feeder belt. Consequently, the slits in the detection belt deform, disabling accurate detection of the traveling speed of the feeder belt, similarly to the above-described conventional method.

SUMMARY OF THE INVENTION

This invention has been developed in view of the above-described situations, and it is an object of the invention, therefore, to provide a recording apparatus which can record an image of high quality by accurately detecting a traveling speed of a feeder belt.

To attain the object, the invention provides a recording apparatus including; a plurality of feeder rollers, an endless feeder belt, a plurality of detection rollers; an endless detection belt; at least one pair of nip rollers; a detecting device; and a recording portion. The feeder rollers include a drive roller. The feeder belt is wound around the feeder rollers in order to be circulated around the feeder rollers by operation of the drive roller such that a path of circulation of the feeder belt includes a feeder-belt straight travel zone at which the feeder belt travels straight, the feeder belt feeding a recording medium. The endless detection belt is a member formed separately from the feeder belt and wound around the detection rollers such that the detection belt is circulated with the feeder belt by contacting the circulated feeder belt at at least a part of the feeder-belt straight travel zone which part constitutes an overlapping zone. The detection belt has a plurality of detection marks arranged at constant intervals along an extending direction of the detection belt. Each pair of the nip rollers cooperate with each other to nip the feeder belt and the detection belt together, at at least a part of the overlapping zone. The detecting device detects the detection marks in the detection belt. The recording portion records an image on the recording medium as fed by the feeder belt, according to a result of the detection by the detecting device.

According to this recording apparatus, the detection belt having the detection marks and the feeder belt are discrete members, and the detection belt contacts the feeder belt at the overlapping zone to travel together. In the conventional arrangement where the detection belt is fixed to the feeder belt in order to circulate the detection belt with the feeder belt, the detection belt tends to come off the feeder belt due to integrally circulating the detection and feeder belts. In the present recording apparatus, on the other hand, the detection belt is not deformed at a zone where the detection belt and the feeder belt travel in contact with each other, and the detection belt does not undesirably come off the feeder belt at a zone where it is desired that the detection and feeder belts are held in contact with each other. Thus, the detection belt can be circulated at the same traveling speed as the feeder belt.

This enhances the accuracy in detecting the traveling speed of the feeder belt. The highly accurate detection of the traveling speed enables a highly accurate adjustment of the recording position on the recording medium, thereby enhancing the quality of the recorded image. The adjustment of the recording position is implemented, for instance, such that (i) a traveling speed of the feeder belt is adjusted, (ii) a speed at which the recording medium is supplied onto the feeder belt is adjusted, and (iii) ink ejection timings are controlled in the case where the recording apparatus is of inkjet type where an image is recorded on the recording medium by the recording portion ejecting droplets of ink onto the recording medium.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 3A is an enlarged cross-sectional view of a portion A shown in FIG. 2, while

FIG. 10A is an enlarged plan view of a feeder belt and interrupters in a recording apparatus according to a sixth embodiment, while

DETAILED DESCRIPTION OF PREFERRED EMBODIMENTS

Hereinafter, there will be described presently preferred embodiments of the invention, by referring to the accompanying drawings.

Figure 1:
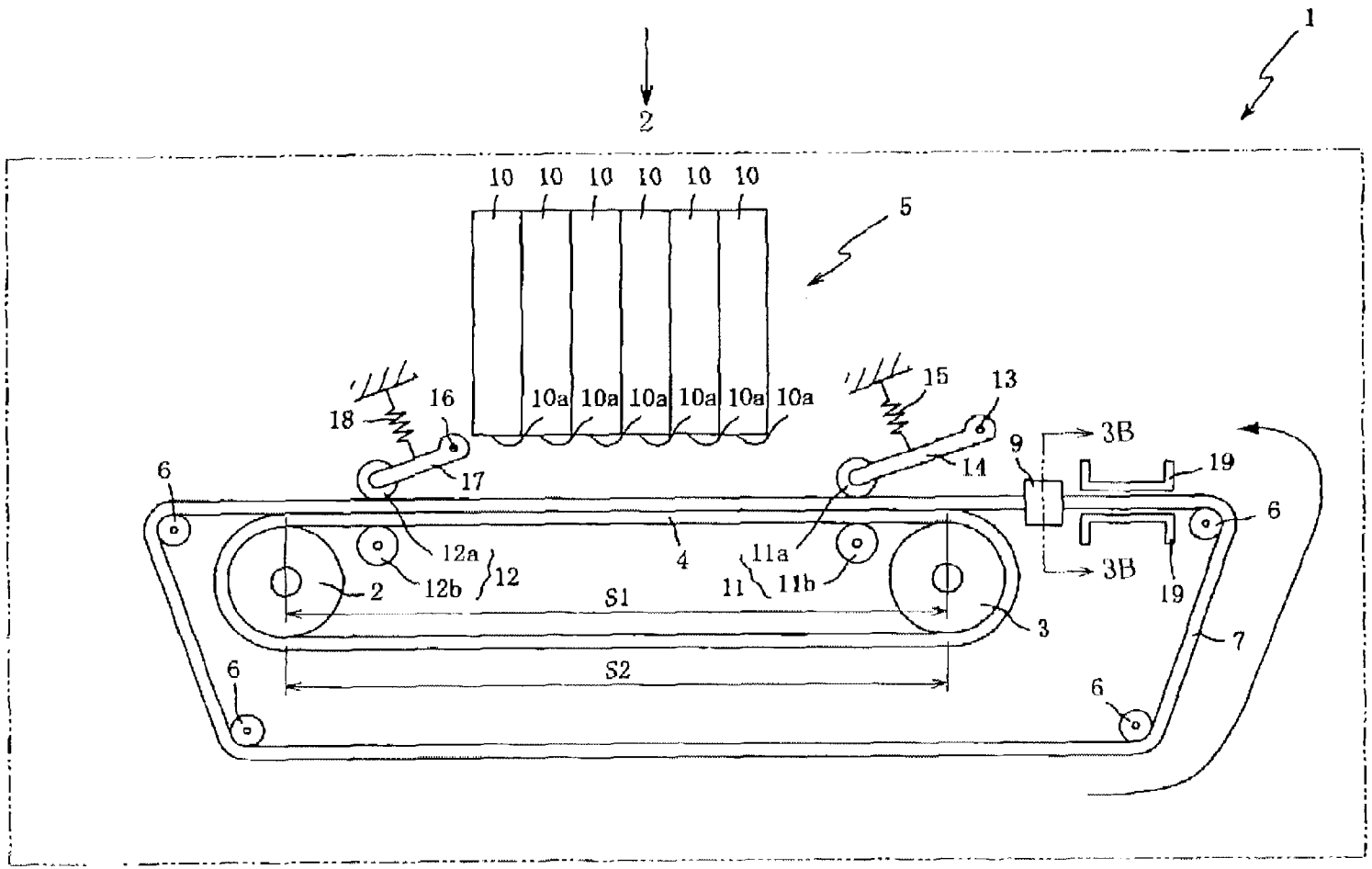
FIG. 1 is an internal side view of a recording apparatus according to a first embodiment of the invention.
Figure 2:
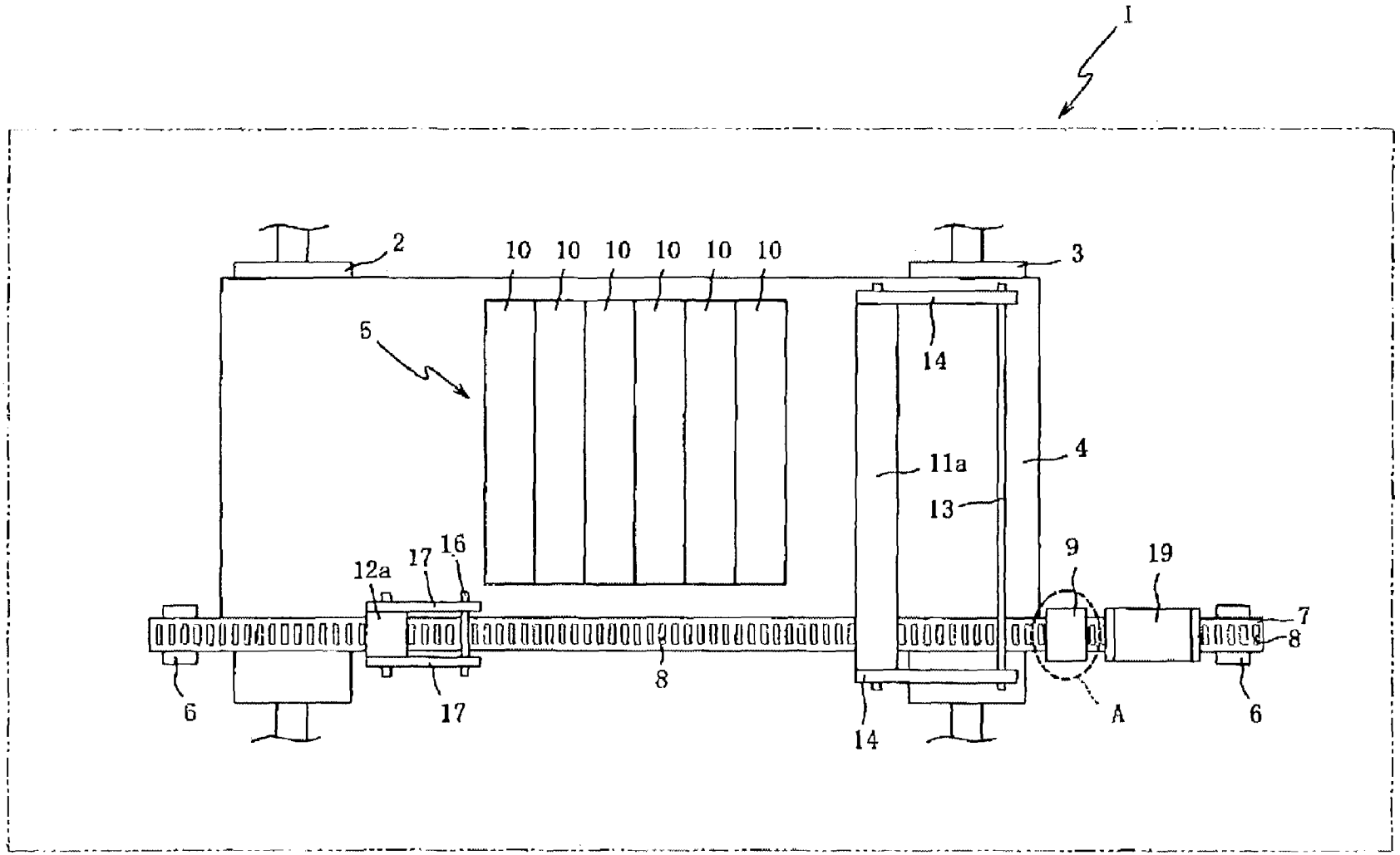
FIG. 2 is a plan view of the recording apparatus as seen in a direction indicated by arrow 2.

There will be described a recording apparatus according to a first embodiment of the invention, by referring to FIGS. 1-4. In FIGS. 1 and 2, a reference numeral 1 generally denotes the recording apparatus, which includes a housing that is indicated by two-dot chain line. In FIG. 2, coil springs 15, 18 shown in FIG. 1 are not shown.

The recording apparatus 1 is an inkjet recording apparatus that forms an image on a recording medium by ejecting ink droplets onto the recording medium. The recording apparatus 1 is capable of detecting a traveling speed of a feeder belt 4 with high accuracy, to enhance the quality of the image recorded on the recording medium.

The recording apparatus 1 is principally constituted by the feeder belt 4, a head unit 5 as a recording portion, an endless detection belt 7 and an interrupter 9 as a detecting device. The feeder belt 4 is an endless belt wound around a drive roller 2 and a driven roller 3 as feeder rollers. The head unit 5 is disposed above, and opposed to, the feeder belt 4. The endless detection belt 7 is wound around four detection rollers 6 to encircle the feeder belt 4. The interrupter 9 reads slits 8, which are formed in the detection belt 7 and serve as detection marks to be detected to determine the traveling speed of the feeder belt 4.

The feeder belt 4 is circulated by operating the drive roller 2, in order to feed the recording medium to a position to be opposed to the head unit 5. More specifically, the feeder belt 4 is circulated in the counterclockwise direction as indicated by an arrow in FIG. 1, by a driving force transmitted from the drive roller 2, in order to feed each of recording media as supplied from a medium supply portion (not shown) disposed on the upstream side (i.e., on the right-hand side as seen in FIG. 1) of the feeder belt 4 with respect to a feeding direction along which the recording medium is fed, down to a medium ejection portion (not shown) disposed on the downstream side (i.e., on the left-hand side as seen in FIG. 1) of the feeder belt 4 in the same direction.

The drive roller 2 is rotated by a driving force of a feeder motor 28 (shown in FIG. 4) transmitted via a transmitting belt (not shown). The driven roller 3 is rotated by a driving force of the drive roller 2 transmitted via another transmitting belt (not shown).

An outer surface of the feeder belt 4, that is, a side of the feeder belt 4 indirectly on which the recording medium is fed, is siliconized to form a close contact layer which is adhesive and capable of holding and feeding the recording medium.

The head unit 5 ejects droplets of ink at predetermined timings onto the recording medium as being fed by the feeder belt 4, in order to record an image on the recording medium. The head unit 5 includes six recording heads 10 arranged in the feeding direction of the recording medium. Each of the recording heads 10 has the shape of an elongate rectangular parallel piped, and the longitudinal direction of each recording head 10 is parallel to a direction of a width of the recording medium (i.e., a direction perpendicular to a surface of the sheet in which FIG. 1 is presented).

An under surface of each recording head 10 constitutes a nozzle surface 10*a* in which are arranged a plurality of nozzles from which ink is ejected in the form of droplets. The color of the ink ejected from the recording heads 10 is different from head to head, that is, the six recording heads 10 are for ejecting inks of respective colors, namely, cyan, light cyan, magenta, light magenta, yellow, and black.

The nozzle surface 10*a* of each recording head 10 is spaced from the feeder belt 4 by a suitable clearance. When the recording medium passes through the clearance, ink droplets are ejected onto the recording medium, thereby forming a desired color image on the recording medium. The timings at which the recording heads 10 eject ink droplets are controlled in accordance with a recording control program 21*a* (described later) based on the traveling speed of the feeder belt 4.

Figure 3A:
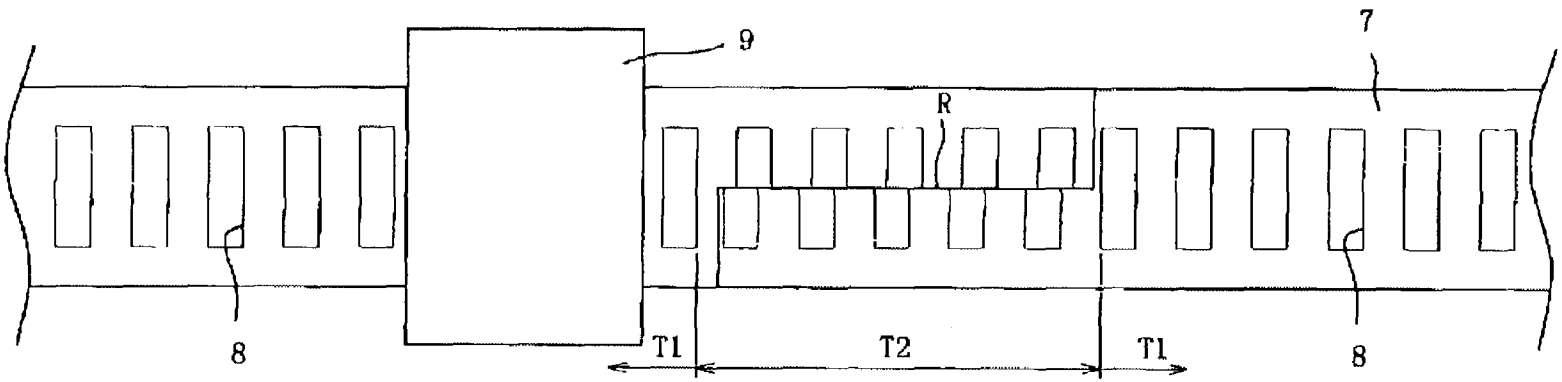

The detection marks to be detected in order to determine the traveling speed of the feeder belt 4 are provided in the form of slits 8 arranged in the detection belt 7. The detection belt 7 that is endless is formed such that a band with two opposite ends is first prepared, and then the opposite ends are connected to each other as indicated by connection line R in FIG. 3A. More specifically, the opposite ends of the band have respective shapes that are complementary to each other such that when the opposite ends are connected, the width of the detection belt 7 is constant over the entirety thereof including the place of the connection The shapes of the opposite ends of the band may not be limited to those as shown in FIG. 3A, but may be any other pair of mutually complementary shapes. A width of each slit 8 and an interval between each two adjacent slits 8 are so small that it is considerably difficult to have all the intervals between the slits 8 exactly the same. Hence, the detection belt 7 includes an equal interval area T1 and an unequal interval area T2, and the slits 8 are arranged regularly in the former area T1 but irregularly in the latter area T2.

By executing the recording control program 21*a* (described later), there is implemented a control operation such that the timing of ink ejection is not disordered even while the slits 8 in the unequal interval area T2 are read.

A path of circulation of the feeder belt 4 includes feeder-belt straight travel zone that includes a straight-travel-zones overlapping zone S1 and an opposed straight zone S2 located under the straight-travel-zones overlapping zone S1. The circulated feeder belt 4 is not bent within the straight-travel-zones overlapping zone S1. The detection belt 7 and the feeder belt 4 are together nipped between a first pair 11 of nip rollers and also between a second pair 12 of nip rollers, which pairs 11, 12 of nip rollers are disposed within the straight-travel-zones overlapping zone S1. Thus, the detection belt 7 is held in contact with the feeder belt 4 while traveling across the straight-travel-zones overlapping zone S1.

The first and second pairs 11, 12 of nip rollers are disposed at respective positions at opposite ends of the straight-travel-zones overlapping zone S1. More strictly, the pairs 11, 12 of nip rollers are disposed in the vicinity of the ends of the straight-travel-zones overlapping zone S1. Preferably, the pairs 11, 12 of nip rollers are disposed as close as possible to the ends of the straight-travel-zones overlapping zone S1.

In this embodiment, the first and second pairs 11, 12 of nip rollers are disposed in order that the detection belt 7 travels in the same direction as the feeder belt 4 at the straight-travel-zones overlapping zone S1, and thus an area over which the detection belt 7 contacts the feeder belt 4 is made relatively wide, thereby ensuring contact between the detection belt 7 and the feeder belt 4.

The first pair 11 of nip rollers is located on the upstream side in the feeding direction of the recording medium, with respect to the second pair 12 of nip rollers, and within the straight-travel-zones overlapping zone S1. The first pair 11 of nip rollers consists of a first roller 11*a* and a second roller 11*b*. The first roller 11*a* and the second roller 11*b* are located on the outer and inner sides of the feeder belt 4, respectively.

More specifically, the first roller 11*a* extends in a direction of the width of the recording medium and of the detection belt 7, and an axial length of the first roller 11*a* is determined to be not smaller than a sum of the width of the recording medium and a dimension over which the detection belt 7 overlaps and contacts the feeder belt 4, in order to reliably press the recording medium onto the feeder belt 4 while the recording medium is carried on the feeder belt 4. However, it suffices that an axial length of the first roller 11*a* is such that the pair 11 of the nip rollers 11*a*, 11*b* can nip therebetween the detection belt 7 and the feeder belt 4 that are overlapping, as well as at least a widthwise end portion of the recording medium on the side of the detection belt 7, within the straight-travel-zones overlapping zone S1. The first roller 11*a* thus contacts the outer surfaces of the feeder belt 4 and the detection belt 7. On the other hand, the second roller 11*b* has the same axial length as the first roller 11*a* and is disposed in contact with the inner surface of the feeder belt 4 such that the feeder belt 4 and the detection belt 7 are nipped between the first roller 11*a* and the second roller 11*b*.

The first roller 11*a* is rotatably held by an arm 14 that is supported pivotally around an axis 13. A coil spring 15 is connected to the arm 14 in a compressed state, as shown in FIG. 1. That is, the first roller 11*a* is biased by a resiliency or an elastic restoring force of the coil spring 15, toward the second roller 11*b*.

On the other hand, the second roller 11*b* supports the first roller 11*a* from a side of the feeder belt 4 and the detection belt 7 which side is opposite to the first roller 11*a*, thereby preventing deformation of the feeder belt 4 and the detection belt 7 due to a pressing force of the first roller 11*a*. Thus, the first pair 11 of nip rollers press the recording medium as being fed between the first roller 11*a* and the feeder belt 4, onto the feeder belt 4, in order to prevent the recording medium from getting off of the feeder belt 4. Further, the first pair 11 of nip rollers press the detection belt 7 onto the feeder belt 4 in order to hold the detection belt 7 in contact with the feeder belt 4 at the straight-travel-zones overlapping zone S1.

In this way, according to the present embodiment, a pair of nip rollers functions to hold down the recording medium as well as the detection belt 7 onto the feeder belt 4, thereby making it unnecessary to provide a pair of nip rollers for holding down or pressing each of the recording medium and the detection belt 7 onto the feeder belt 4. Thus, the number of components can be reduced, which enables reduction in the component cost and the assembly cost, that is, the manufacturing cost of the recording apparatus is reduced. Accordingly, the product cost of the recording apparatus 1 as a whole can be reduced. However, if desired, it may be arranged such that a pair of nip rollers is provided for pressing each of the recording medium and the detection 7 onto the feeder belt 4.

The second pair 12 of nip rollers is disposed on the downstream side in the feeding direction of the recording medium with respect to the first pair 11 of nip rollers, and within the straight-travel-zones overlapping zone S1. The second pair 12 of nip rollers consists of a first roller 12*a* disposed in contact with the outer surface of the detection belt 7 and a second roller 12*b* disposed in contact with the inner surface of the feeder belt 4. The detection belt 7 and the feeder belt 4 are nipped between the first roller 12*a* and the second roller 12*b*.

The first roller 12*a* is rotatably held by an arm 17 that is supported pivotally around an axis 16, in a similar way as the first roller 11*a* of the first pair 11 of nip rollers. A coil spring 18 is connected to the arm 17 in a compressed state, as shown in FIG. 1. That is, the first roller 12*a* is biased by a resiliency or an elastic restoring force of the coil spring 18, toward the second roller 12*b*.

The second roller 12*b* supports the first roller 12*a* from a side of the feeder belt 4 and the detection belt 7 which is opposite to the first roller 12*a*, thereby preventing deformation of the feeder belt 4 and the detection belt 7 due to a pressing force of the first roller 12*a*. Thus, the second pair 12 of nip rollers press the detection belt 7 onto the feeder belt 4 in order to hold the detection belt 7 in contact with the feeder belt 4 at the straight-travel-zones overlapping zone S1.

Thus, in the presence of the first and second pairs 11, 12 of nip rollers, the detection belt 7 is held in contact with the outer surface of the feeder belt 4 across the straight-travel-zones overlapping zone S1, thereby enabling the detection belt 7, which is a member formed separately from the feeder belt 4, to travel together with the feeder belt 4. In the conventional technique where the detection belt is fixed to the feeder belt in order to circulate the detection belt with the feeder belt, the detection belt tends to come off the feeder belt due to integrally circulating the detection and feeder belts. On the other hand, the present embodiment enables to circulate the detection belt 7 at the same traveling speed as the feeder belt 4, without causing deformation of the detection belt 7 at a zone where the detection belt 7 and the feeder belt 4 are held in contact with each other. Thus, the detection belt 7 is prevented from coming off the feeder belt 4 at a zone where contact therebetween is desired.

Since the straight-travel-zones overlapping zone S1 corresponds to a recording-medium feeding zone across which the feeder belt 7 carries thereon the recording medium to feed the recording medium, a traveling speed of the detection belt 7 can be approximated to the feeding speed of the recording medium in a high degree. Hence, the accuracy of the control of the recording position can be enhanced. By disposing a plurality of pairs (two pairs 11, 12 in this specific example) of nip rollers, the detection belt 7 can be held in contact with the feeder belt 4 across an entirety of the straight-travel-zones overlapping zone S1, thereby enabling to feed the detection belt 7 together with the feeder belt 4 across the entire straight-travel-zones overlapping zone S1. Compared to the case where the detection belt 7 is fed with the feeder belt 4 only at a part of the straight-travel-zones overlapping zone S1, this arrangement can further approximate the traveling speed of the detection belt 7 to the traveling speed of the feeder belt 4 and accordingly the feeding speed of the recording medium. Thus, the recording position can be controlled with high accuracy:

The detection belt 7 is preferably formed of a material less stretchable than a material forming the feeder belt 4. For instance, polyethylene terephthalate may be employed as the material forming the detection belt 7. When the detection belt 7 is formed of such a material, deformation of the slits 8 is restricted even at a zone where the detection belt 7 travels in a bent state.

Figure 3B:
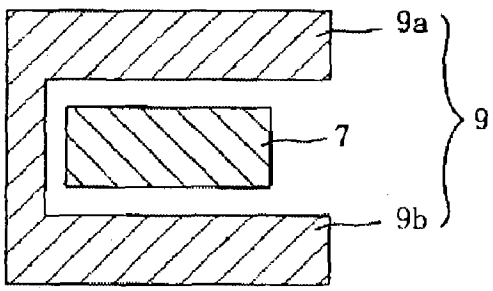
FIG. 3B is an enlarged cross-sectional view of an interrupter, taken along line 3B-3B in FIG. 1.

The interrupter 9 is a sensor that can optically read the slits 8, and includes an emitter 9*a* as a light emitting element that emits light, and a director 9*b* as a light receiving element that receives the light emitted from the emitter 9*a*. The emitter 9*a* and the director 9*b* are disposed with a suitable clearance therebetween, as shown in FIG. 3B. The interrupter 9 is disposed such that the detection belt 7 can pass through the clearance between the emitter 9*a* and the director 9*b*.

The interrupter 9 is constructed such that when the detection belt 7 passes through the clearance between the emitter 9*a* and the director 9*b*, the light emitted from the emitter 9*a* passes through a slit 8 located under the emitter 9*a* to be incident on the director 9*b*. Upon receiving the light, the director 9*b* outputs a detection signal indicative of the slit 8 having been detected, to a CPU 20 described later. The traveling speed of the feeder belt 4 is calculated based on the detection signals, in accordance with the recording control program 21*a* described later, and the ink ejection timings are controlled based on the thus obtained traveling speed of the feeder belt 4.

On the upstream side of the interrupter 9, a vertical guide 19 is disposed The vertical guide 19 forms a directing passage along which the detection belt 7 is guided into the clearance between the emitter 9*a* and the director 9*b*. More specifically, the vertical guide 19 includes two members that are respectively disposed on opposite sides of a path of circulation of the detection belt 7, thereby defining the directing passage.

Although not shown, there is disposed at least one widthwise guide that guides the detection belt 7 such that the position of the detection belt 7 with respect to its width direction is determined by the at least one guide.

The vertical guide 19 and the at least one widthwise guide serve to smoothly introduce the detection belt 7 into the clearance between the emitter 9*a* and the director 9*b* of the interrupter 9, thereby enhancing the reliability of detection of the slits by the interrupter 9.

Figure 4:
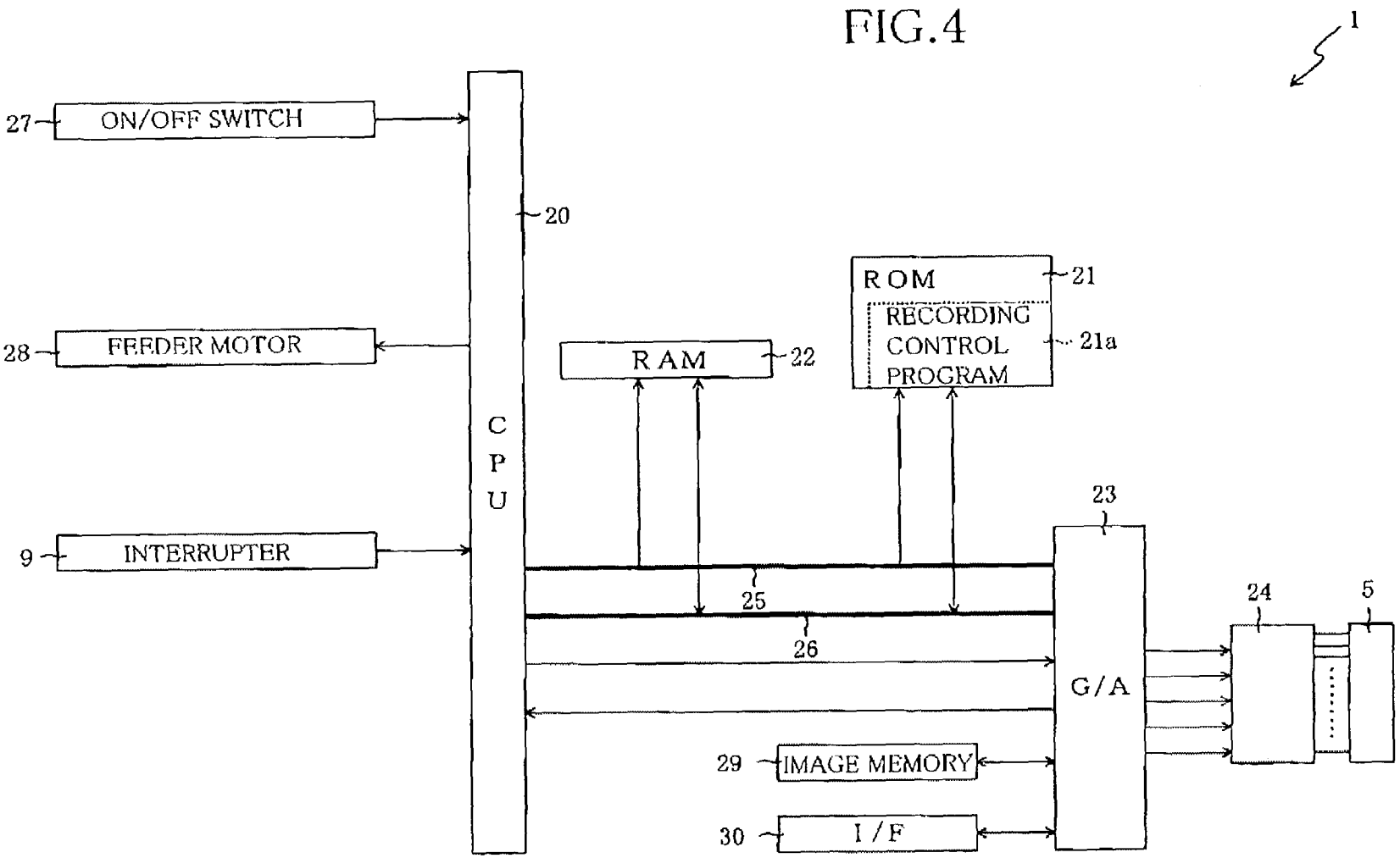
FIG. 4 is a block diagram showing an electrical structure of the recording apparatus.

There will be now described an electrical structure of the recording apparatus 1, by referring to a block diagram of FIG. 4.

The recording apparatus 1 includes a CPU 20 in the form of a one-chip microcomputer, a ROM 21, a RAM 22, a gate array (G/A) 23, and a recording head driver 24, that are connected to one another via an address bus 25 and a data bus 26.

The CPU 20, which is a computing unit, controls ink ejection timings according to the recording control program 21*a* stored in the ROM 21. To the CPU 20 are connected an on/off switch 27 for switching on/off the recording apparatus 1, the feeder motor 28 that is a drive source for driving the drive roller 2, and the interrupter 9, and operation of each of these devices 27, 28, 9 is controlled by the CPU 20.

The ROM 21 is a non-volatile memory that is not rewritable, and stores the recording control program 21*a* which is executed by the CPU 20 and according to which ink ejection timings are controlled. The recording control program 21*a* is a program for calculating the traveling speed of the feeder belt 4 based on the detection signals outputted from the interrupter 9, and controlling the ink ejection timings based on the obtained traveling speed of the feeder belt 4.

The result of the detection of the slits 8 by the interrupter 9 is so reliable that the traveling speed of the feeder belt 4 as calculated is highly accurate. Hence, ink droplets are ejected exactly at the desired timings, thereby enabling recording of an image of high quality on the recording medium.

The recording control program 21*a* is made such that the ink ejection timings are not disordered even when the slits 8 formed in the unequal interval area T2 (shown in FIG. 3A) are detected.

That is, there is contained an irregularity in the result of detection of the slits 8 formed within the unequal interval area T2. During a recording operation, when the traveling speed of the feeder belt 4 is calculated based on the result of detection of these slits 8 within the unequal interval area T2, the ink ejection timings would be disordered. Hence, in the present embodiment, when a cycle of recording operation is performed, timing to initiate feeding of the recording medium is controlled such that the slits 8 in the unequal interval area T2 are not to be detected during the recording operation of that cycle.

More specifically, as information specific to a particular recording apparatus 1, the ROM 21 stores, for the recording control program 21*a* to reference, (i) a time interval between a detection of the unequal interval area T2 (or the slits 8 within that area T2) and the next detection thereof, i.e., a cycle of detection of the area T2 (or the slits 8 within that area T2), and (ii) a relationship between a time period elapsed from an initiation of feeding of a recording medium and a position of the recording medium relative to a position at which the recording medium is located when the feeding is initiated, both of (i) and (ii) being those in the case where the feeder belt 4 is circulated at a predetermined traveling speed. The CPU 20 controls the timing of initiation of feeding of the recording medium, according to the recording control program 21*a*, and based on the specific information and the result of detection of the unequal interval area T2 (or the slits 8 within that area T2) by the interrupter 9. In this way, such a control that the slits 8 formed in the unequal interval area T2 are not to be detected during one cycle of recording operation, thereby preventing occurrence of a disorder in ink ejection timings.

The RAM 22 is a rewritable volatile memory, and temporarily stores various kinds of data.

The gate array 23 outputs various kinds of signals in accordance with ejection timing signals transferred from the CPU 207 and based on image data stored in an image memory 29. The signals outputted from the gate array 23 are: drive signals corresponding to the image data, based on which the image represented by the image data, is recorded on the recording medium; transfer clock signals CLK synchronized with the image data; latch signals; parameter signals based on which basic image recording waveform signals are generated; and ejection timing signals JET that are periodically outputted. These signals are outputted to the recording head driver 24 The gate array 23 has the image memory 29 store image data as transferred from an external device via an interface (I/F) 30.

The recording head driver 24 is a drive circuit that receives the signals from the gate array 23, and applies, to a drive element corresponding to each of the nozzles, drive pulses of a waveform according to the received signals. The drive element is operated in accordance with the drive pulses, thereby ejecting ink droplets from the nozzle.

In the present embodiment, detection marks to be detected in order to determine the traveling speed of the feeder belt 4 take the form of slits 8. This is advantageous since slits can be easily and economically formed in the detection belt 7.

Figure 5:
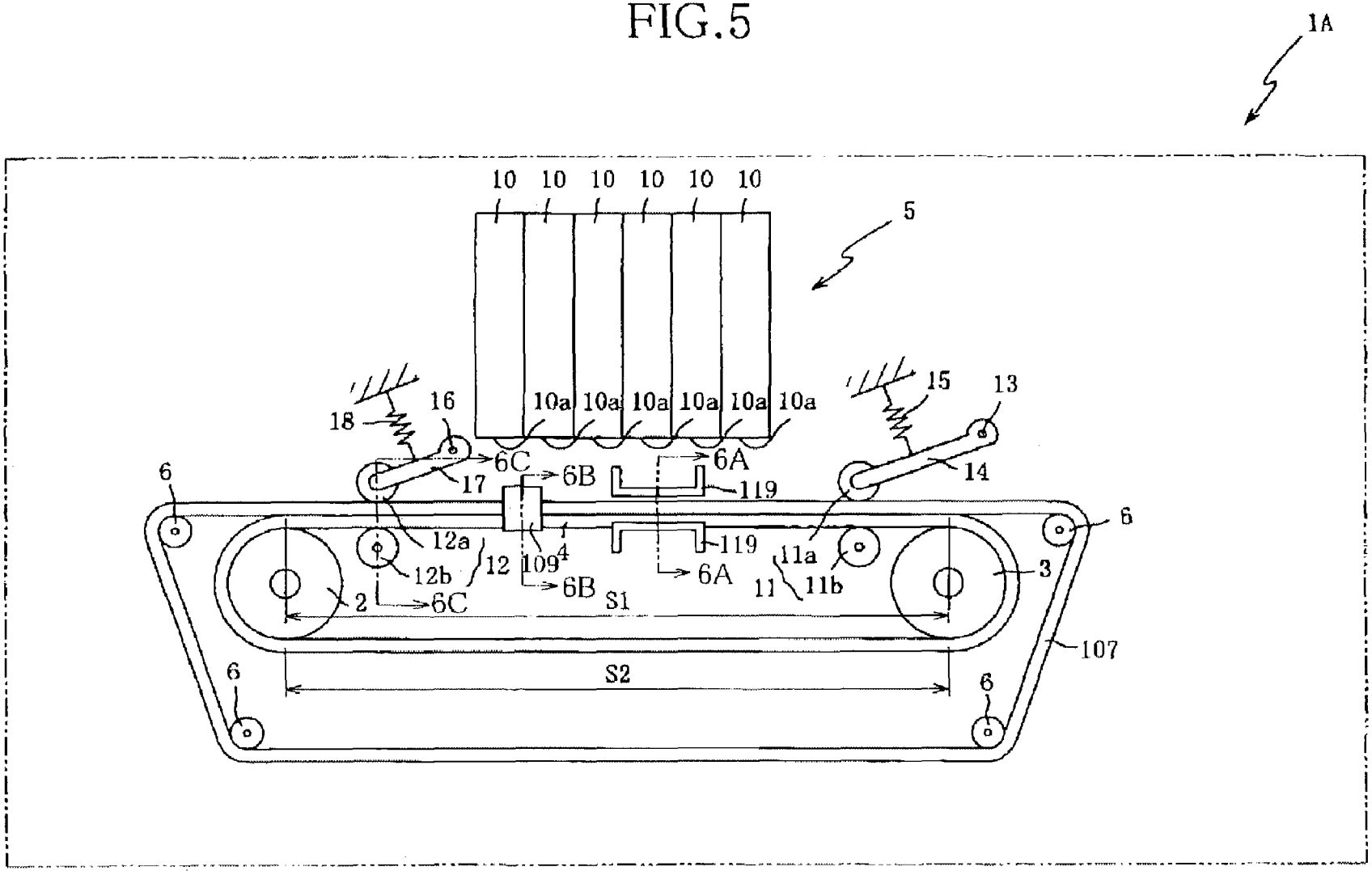
FIG. 5 is an internal side view of a recording apparatus according to a second embodiment of the invention.
Figure 6A:
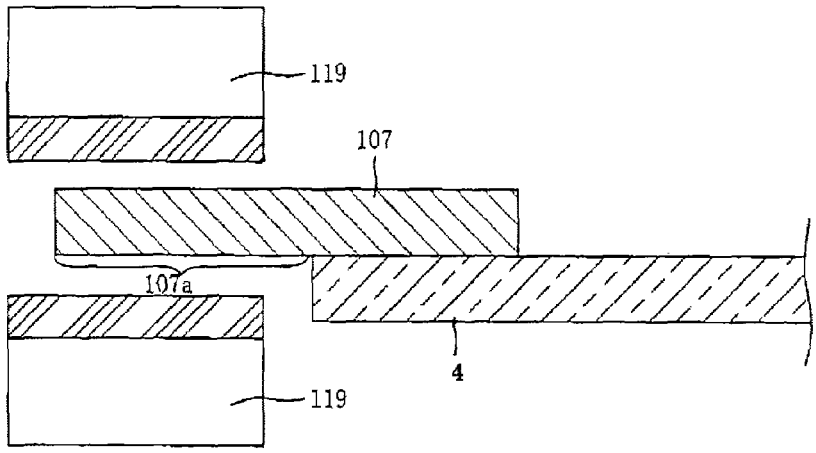
FIGS. 6A, 6B and 6C are cross-sectional views respectively taken along lines 6A-6A, 6B-6B, and 6C-6C in FIG. 5.
Figure 6B:
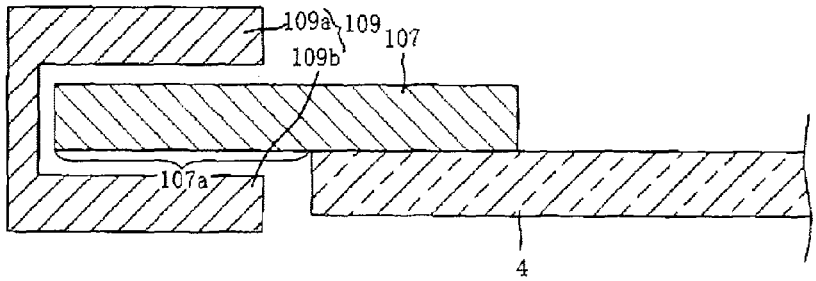
Figure 6C:
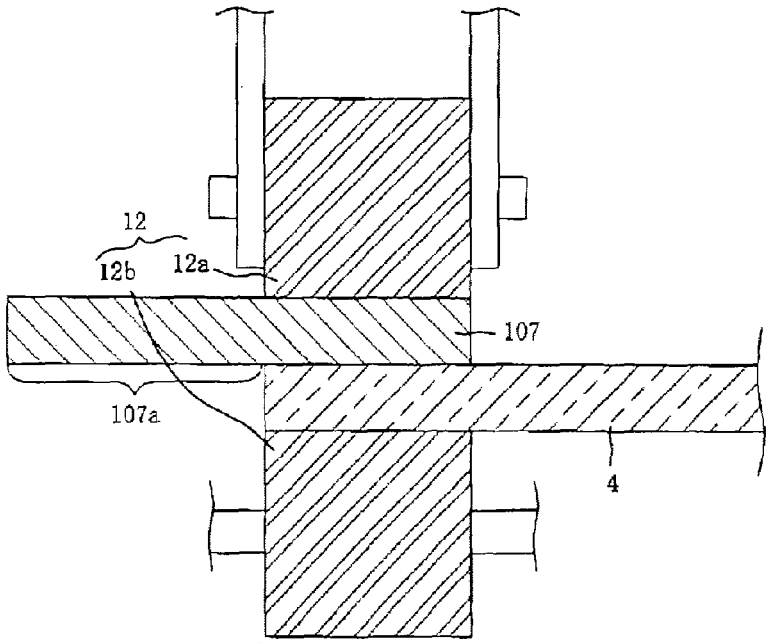

There will be now described a recording apparatus according to a second embodiment of the invention, by referring to FIGS. 5 and 6. FIG. 5 is an internal side view of a recording apparatus 1A of the second embodiment. FIGS. 6A, 6B, and 6C are cross-sectional views respectively taken along line 6A-6A, 6B-6B, and 6C-6C in FIG. 5. The elements or parts corresponding to those of the recording apparatus 1 of the first embodiment are denoted by the same reference numerals and description thereof is omitted.

In the recording apparatus 1 of the first embodiment, the detection belt 7 is disposed at one of opposite edges of the feeder belt 4 such that the detection belt 7 is on the feeder belt 4 over an entire width thereof, as shown in FIG. 2. Hence, in order to introduce the detection belt 7 into the clearance between the emitter 9*a* and the director 9*b* of the interrupter 9, the interrupter 9 and the vertical guide 19 are essentially disposed at a position where the detection belt 7 and the feeder belt 4 do not overlap. Thus, in the recording apparatus 1 of the first embodiment, the interrupter 9 and the vertical guide 19 are disposed at a place away from the feeder belt 4, namely, to the right of the feeder belt 4 as seen in FIG. 1.

On the other hand, in the recording apparatus 1A of the second embodiment, a feeder belt 4 and a detection belt 107 are superposed on each other such that in a straight-travel-zones overlapping zone S1, one of opposite edges of the detection belt 107 protrudes from a corresponding one of opposite edges of the feeder belt 4, as shown in FIGS. 6A-6C. A plurality of slits 8 are formed in a protruding portion 107*a* of the detection belt 107 which portion does not overlap the feeder belt 4. An interrupter 109 including an emitter 109*a* and a director 109*b*, and a vertical guide 119, are disposed at a position at a widthwise side of the feeder belt 4 and the protruding portion 107*a* of the detection belt 107 is introduced into a clearance between the emitter 109*a* and the director 109*b* of the interrupter 109. In this embodiment, the vertical guide 119 is not essential, since the detection belt 107 is held by adhesion on an outer surface of the feeder belt 4 having a tackiness. However, the protruding portion 107*a* of the detection belt 107 located outside the edge of the feeder belt 4 may shake or move up and down, and thus it is preferable that the vertical guide 119 is disposed on the upstream side of the interrupter 109.

Thus, the detection belt 107 is disposed on the feeder belt 4 such that an edge of the detection belt 107 protrudes outward or sideward from the corresponding edge of the feeder belt 4 at the straight-travel-zones overlapping zone S1, thereby enabling to dispose the interrupter 109 and the vertical guide 119 at a side of the feeder belt 4 in the lateral or width direction of the feeder belt 4. This is advantageous in reducing the size of the recording apparatus in the feeding direction of the recording medium, as compared to the recording apparatus 1 of the first embodiment where the interrupter 9 is disposed on one of the upstream and downstream sides of the recording-medium feeding zone.

Figure 7:
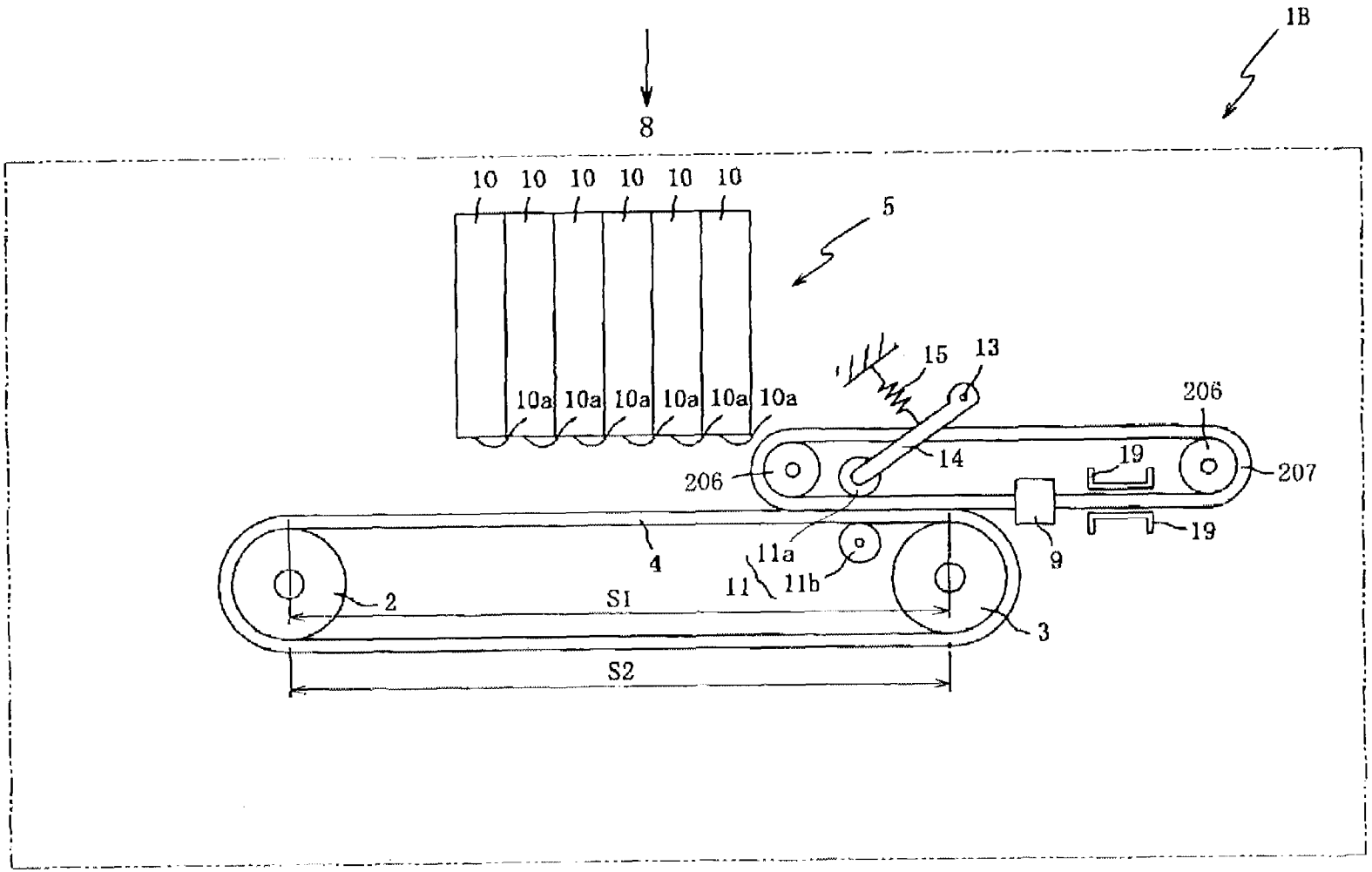
FIG. 7 is an internal side view of a recording apparatus according to a third embodiment of the invention.
Figure 8:
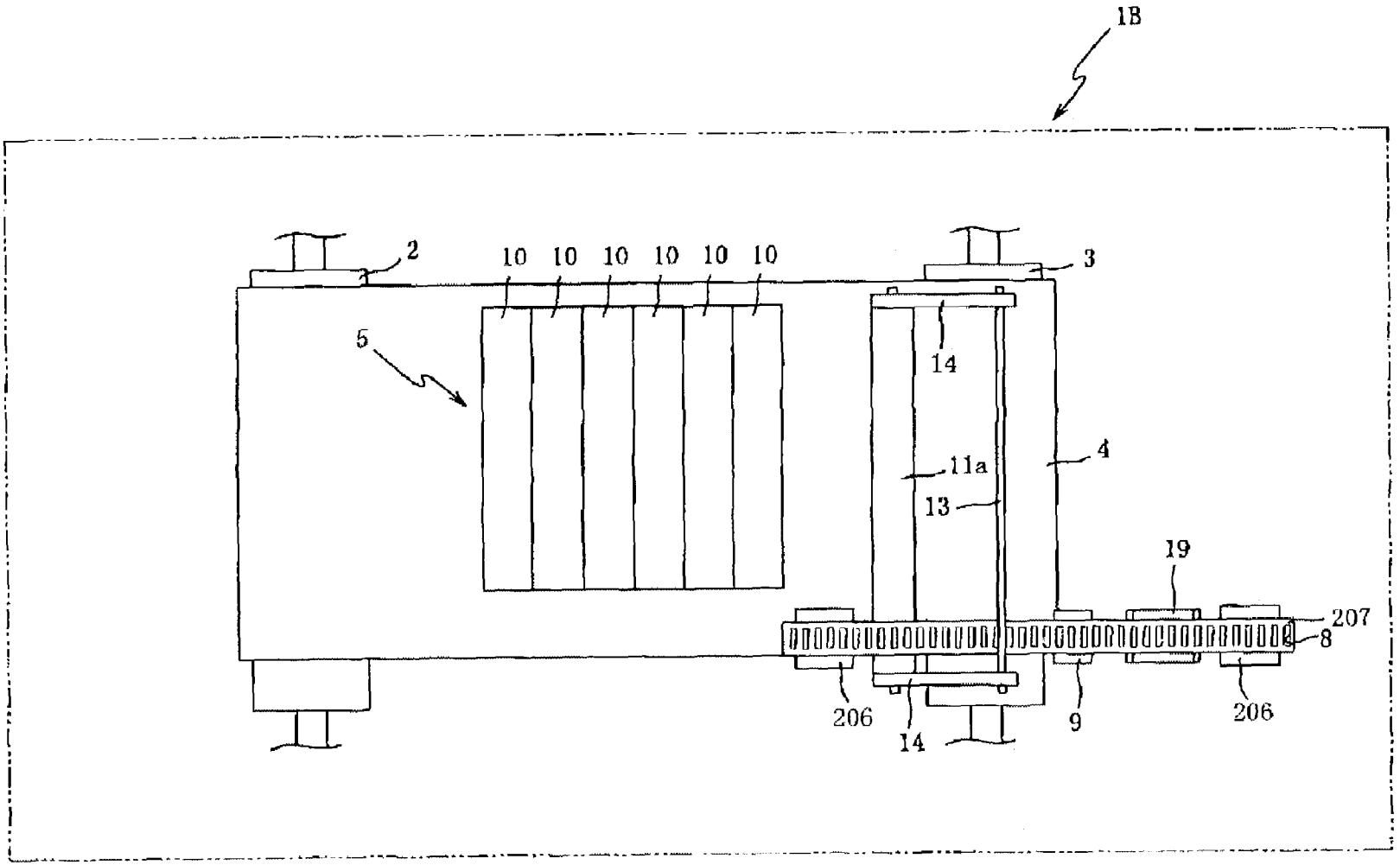
FIG. 8 is a plan view of the recording apparatus as seen in a direction indicated by arrow 8 in FIG. 7.

Referring next to FIGS. 7 and 8, there will be described a recording apparatus according to a third embodiment of the invention. FIG. 7 is an internal side view of a recording apparatus 1B of the third embodiment, and FIG. 8 is a plan view as seen from a direction indicated by arrow 8 in FIG. 7. The parts or elements corresponding to those of the recording apparatus 1 of the first embodiment will be denoted by the same reference numerals and description thereof is omitted.

In the recording apparatus 1 of the first embodiment, the detection belt 7 is disposed to surround the entirety of the feeder belt 4, and overlaps and contacts the feeder belt 4 across the entirety of the straight-travel-zones overlapping zone S1. On the other hand, in the recording apparatus 1B of the third embodiment, a detection belt 207 is disposed on an outer side of a path of circulation of the feeder belt 4, and overlaps and contacts the feeder belt 4 only at a part of a straight-travel-zones overlapping zone S1, namely, only at an upstream part of the zone S1 with respect to the path of circulation of the feeder belt 4.

Forming and disposing the detection belt 207 in this way is advantageous in that an overall length of the detection belt 207 is made smaller than that of the detection belt 7 in the first embodiment, thereby reducing the overall size of the recording apparatus 1B, while the same effects as the first embodiment can be obtained.

According to the third embodiment where the overall length of the detection belt 207 is relatively small, the detection belt 207 is wound around only two detection rollers 206 in order to circulate the detection belt 207 while slackening thereof is inhibited, in contrast to the first embodiment where the detection belt 7 is wound around four detection rollers 6.

Since an amount or a distance by which the detection belt 207 and the feeder belt 4 overlap in the straight-travel-zones overlapping zone S1 is reduced in the third embodiment, the second pair 12 of nip rollers used in the first embodiment is made unnecessary and omitted, and the detection belt 207 is wound around only a pair 11 of nip rollers. That is, in order to have the detection belt 207 contact the feeder belt 4 in the straight-travel-zones overlapping zone S1, the detection belt 207 and the feeder belt 4 are together nipped between a single pair 11 of nip rollers, thereby enabling the detection belt 207 to travel with the feeder belt 4 at the straight-travel-zones overlapping zone S1. Thus, the manufacturing cost of the recording apparatus 1B is reduced due to reduction in the number of components.

Figure 9A:
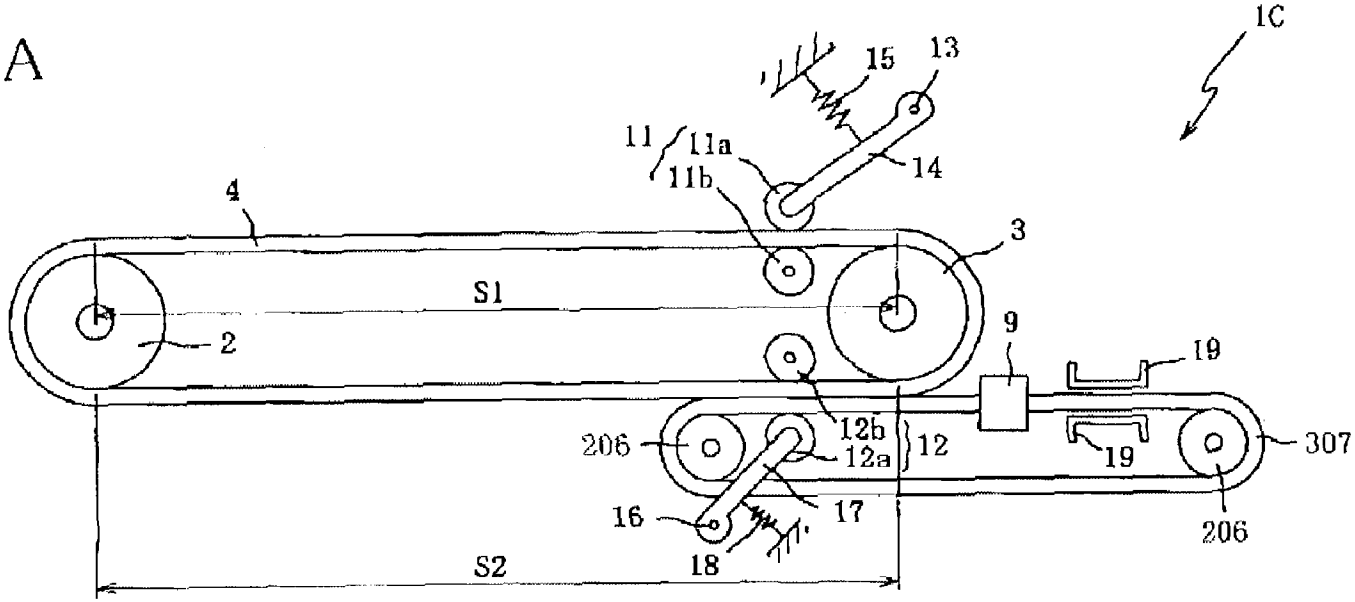
FIG. 9A is an enlarged side view of a feeder belt and a detection belt in a recording apparatus according to a fourth embodiment of the invention.

There will be now described a recording apparatus according to a fourth embodiment of the invention, by referring to FIG. 9A. FIG. 9A is an enlarged side view of a feeder belt 4 and a detection belt 307 in a recording apparatus 1C of the fourth embodiment. Since the fourth embodiment is a modification of the third embodiment, namely, merely the position of the detection belt 207 relative to the feeder belt 4 is changed, irrelevant elements such as the head unit 5 are not shown.

In the recording apparatus 1B of the third embodiment, the detection belt 207 is disposed to overlap the feeder belt 4 only at a part of the straight-travel-zones overlapping zone S1 across which the recording medium is carried on the feeder belt 4. On the other hand) in the recording apparatus 1C of the fourth embodiment, a detection belt 307 is disposed to overlap and contact a feeder belt 4 at a part of an opposed straight zone S2 at which a recording medium is not carried on the feeder belt 4. By thus disposing the detection belt 307, possibility that the detection belt 307 contacts the recording medium is eliminated or at least decreased, and a degree of freedom in selecting a position where the detection belt 307 is disposed is enhanced.

In an arrangement of the first embodiment where the detection belt 7 is held in contact with the feeder belt 4 at at least a part of the recording-medium feeding zone across which the feeder belt 4 carries thereon the recording medium to feed the recording medium, the axial length of the first roller 11*a* should not be smaller than a sum of the width of the recording medium and a widthwise dimension over which the detection belt 7 overlaps and contacts the feeder belt 4. However, in the fourth embodiment where the detection belt 307 contacts the feeder belt 4 at a place outside the recording-medium feeding zones it is made unnecessary to increase the width of the feeder belt 4 in order to include the width dimension for overlapping and contact between the feeder belt 4 and the detection belt 307, thereby making relatively small the width of the feeder belt 4 and accordingly the overall size of the recording apparatus 1C.

In the fourth embodiment, the pair 11 of nip rollers 11*a*, 11*b* functions to press the recording medium onto the feeder belt 4, but not to nip the feeder and detection belts 4, 307 together, while the other pair 12 of nip rollers 12*a*, 12*b* functions to nip the feeder and detection belts 4, 307 together but not to press the recording medium onto the feeder belt 4.

Figure 9B:
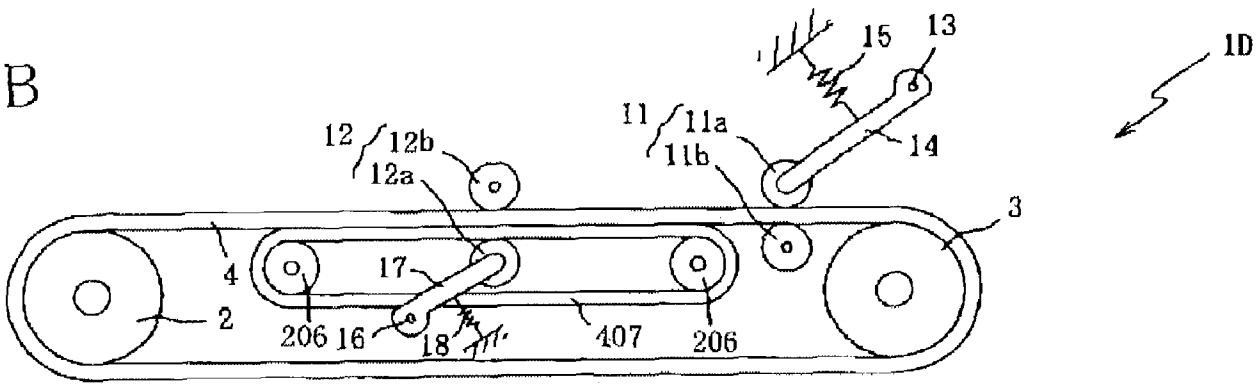
FIG. 9B is an enlarged side view of a feeder belt and a detection belt in a recording apparatus according to a fifth embodiment of the invention.

There will be now described a recording apparatus according to a fifth embodiment, by referring to FIG. 9B. FIG. 9B is an enlarged side view of a feeder belt 4 and a detection belt 407 in a recording apparatus 1D of the fifth embodiment. The fifth embodiment is a modification of the third and fourth embodiments, namely, merely the position of the detection belt 407 relative to the feeder belt 4 is changed, and irrelevant elements such as the head unit 5 are not shown.

In each of the third and fourth embodiments, the detection belt 207, 307 is disposed on the outer surface of the feeder belt 4. On the other hand, in the recording apparatus 1D of the fifth embodiment, a detection belt 407 is disposed to overlap and contact an inner surface of a feeder belt 4, and a second pair 12 of nip rollers nips the feeder belt 4 and the detection belt 407 together, such that the detection belt 407 is in contact with the inner surface of the feeder belt 4.

Thus, in the fifth embodiment, the detection belt 407 requires less space, compared to the case where the detection belt 7, 107, 207, 307 is disposed on the outer side of the path of circulation of the feeder belt 4, thereby preventing much increase in the overall size of the recording apparatus 1D due to inclusion of the detection belt. The recording apparatus of the fifth embodiment reduces occurrence of an inconvenience that the detection belt 407 contacts the recording medium, and makes it unnecessary to increase the width of the feeder belt 4 to include the width dimension over which the detection belt 407 overlaps and contacts the feeder belt 4, thereby reducing an increase in the overall size of the recording apparatus 1D.

Figure 10A:
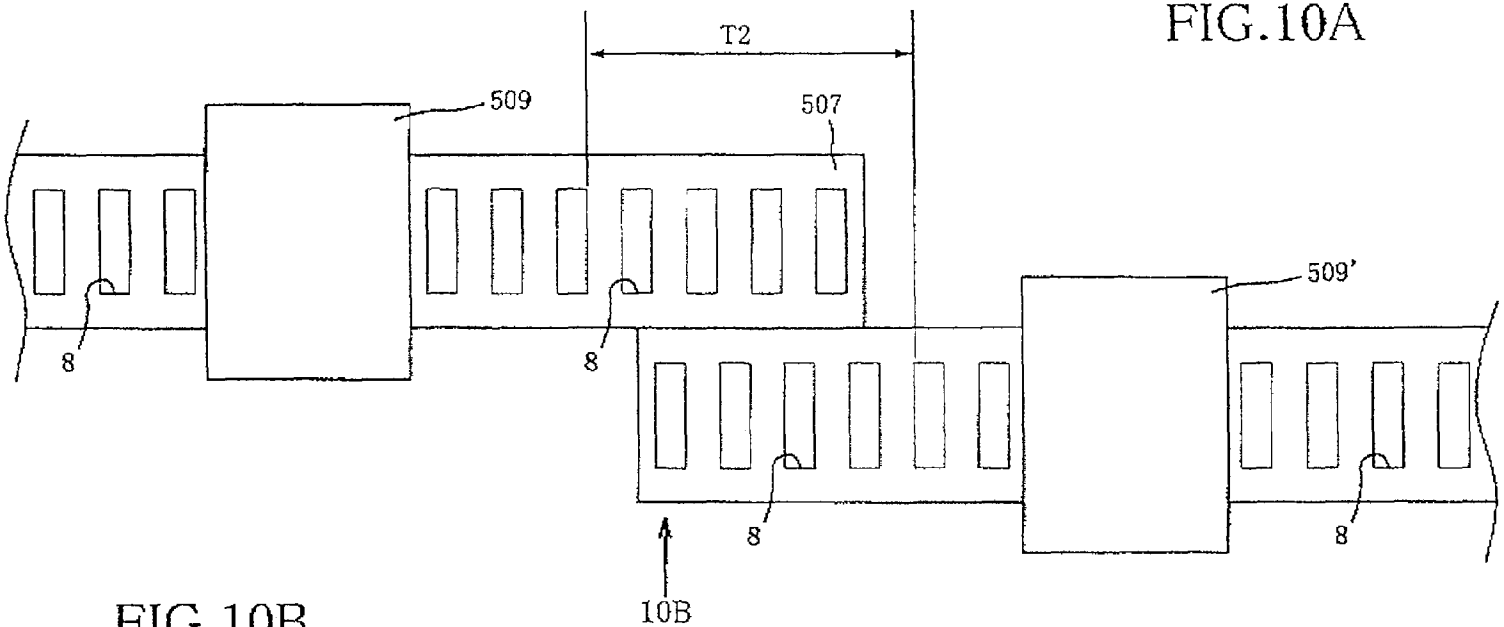
Figure 10B:
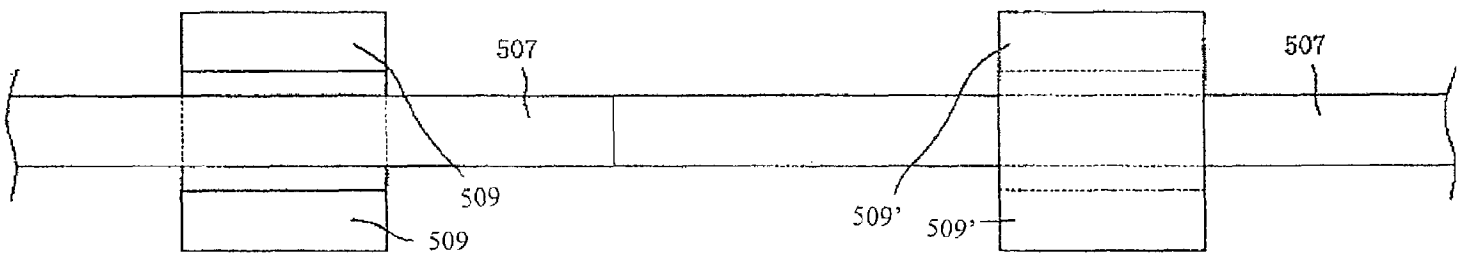
FIG. 10B is a side view as seen in a direction indicated by arrow 10B in FIG. 10A.

There will be now described a recording apparatus according to a sixth embodiment of the invention, by referring to FIG. 10. The sixth embodiment differs from the first embodiment only in the structure of the detection belt, and other parts are the same as each of the above-described embodiments and description thereof is omitted. FIG. 10A is an enlarged plan view of a detection belt 507 and interrupters 509, 509' in the recording apparatus of the sixth embodiment, while FIG. 10B is a side view of the detection belt 507 and the interrupters 509, 509' as seen in a direction indicated by arrow 10B in FIG. 1A.

In each of the above-described embodiments, a band with two opposite ends is first prepared and then the two ends are connected at a connection line R to form the endless detection belt 7, 107, 207, 307, 407, as shown in FIG. 3A. On the other hand, in the sixth embodiment, an endless detection belt 507 is formed by connecting two opposite ends of a band without aligning the opposite ends in a widthwise direction thereof, as shown in FIG. 10A. Two interrupters 509, 509' are disposed with a suitable spacing therebetween. In the sixth embodiment, a recording control program 21*a* is made such that when detection signals from one of the two interrupters 509 cease, detection signals from the other interrupter 509' are obtained or used. This embodiment prevents occurrence of a disorder in ink ejection timings due to detection of slits 8 in an unequal interval area T2 where intervals between the slits 8 are not constant.

Although there have been described the embodiments of the invention, it is to be understood that the invention is not limited to the details of the above-described embodiments but may be otherwise embodied with various modifications and improvements that may occur to those skilled in the art, without departing from the scope and spirit of the invention.

For instance, although in each of the above-described embodiments, the traveling speed of the feeder belt 4 that is obtained by calculation according to the recording control program 21*a* is used for controlling the ink ejection timings, the thus obtained traveling speed of the feeder belt 4 may be used for controlling the timing of initiation of feeding of the recording medium, or the traveling speed of the feeder belt 4.

What is claimed is:

1. A recording apparatus comprising:

a plurality of feeder rollers including a drive roller;

an endless feeder belt which is wound around the feeder rollers in order to be circulated around the feeder rollers by operation of the drive roller such that a path of circulation of the feeder belt includes a feeder-belt straight travel zone at which the feeder belt travels straight, the feeder belt feeding a recording medium;

a plurality of detection rollers;

an endless detection belt which is a member formed separately from the feeder belt and wound around the detection rollers such that the detection belt is circulated with the feeder belt by contacting the circulated feeder belt at at least a part of the feeder-belt straight travel zone which part constitutes an overlapping zone, the detection belt having a plurality of detection marks arranged at constant intervals along an extending direction of the detection belt;

at least one pair of nip rollers, each pair cooperating with each other to nip the feeder belt and the detection belt together, at at least a part of the overlapping zone;

a detecting device which detects the detection marks in the detection belt; and a recording portion which records an image on the recording medium as fed by the feeder belt, according to a result of the detection by the detecting device.

2. The recording apparatus according to claim 1, wherein the detection belt is wound around the detection rollers such that the path of circulation of the detection belt includes a detection-belt straight travel zone where the detection belt travels straight, wherein the overlapping zone includes a straight-travel-zones overlapping zone where at least a part of the detection-belt straight travel zone overlaps at least a part of the feeder-belt straight travel zone, and wherein a traveling direction of the detection belt and a traveling direction of the feeder belt coincide with each other at the straight-travel-zones overlapping zone.

3. The recording apparatus according to claim 2, wherein the path of circulation of the feeder belt includes a recording-medium feeding zone across which the feeder belt feeds the recording medium, and the straight-travel-zones overlapping zone corresponds to the recording-medium feeding zone.

4. The recording apparatus according to claim 3, wherein the recording medium takes the form of a sheet, wherein the detection belt is disposed at a position corresponding to one of opposite edges of the feeder belt, and wherein an axial length of each of the at least one pair of nip rollers, in a direction parallel to a width direction of the feeder belt, is such that each pair of nip rollers can nip, within the straight-travel-zones overlapping zone, at least a widthwise end portion of an overlapping portion of the recording medium where the recording medium overlaps the feeder belt, which widthwise end portion is on the side of the detection belt.

5. The recording apparatus according to claim 2, wherein the at least one pair of nip rollers includes a plurality of pairs of nip rollers which pairs are disposed at respective positions including at least two positions respectively at opposite ends of the straight-travel-zones overlapping zone.

6. The recording apparatus according to claim 2, wherein the detection belt is located inside the path of circulation of the feeder belt such that a portion of an outer surface of the detection belt at the detection-belt straight travel zone contacts a portion of an inner surface of the feeder belt at the feeder-belt straight travel zone, and wherein a zone where the portion of the outer surface of the detection belt and the portion of the inner surface of the feeder belt contact each other corresponds to the straight-travel-zones overlapping zone.

7. The recording apparatus according to claim 1, wherein the straight-travel-zones overlapping zone corresponds to a portion of the feeder-belt straight travel zone, which portion is not a recording-medium feeding zone across which the feeder belt feeds the recording medium.

8. The recording apparatus according to claim 1, wherein the detection belt is wound around the detection rollers such that the path of circulation of the detection belt includes a detection-belt straight travel zone where the detection belt travels straight, wherein the overlapping zone includes a straight-travel-zones overlapping zone where at least a part of the detection-belt straight travel zone overlaps at least a part of the feeder-belt straight travel zone, wherein the detection belt includes a protruding portion which widthwise protrudes, at the straight-travel-zones overlapping zone, from one of opposite edges of the feeder belt, and wherein the detection marks are formed in the protruding portion.

9. The recording apparatus according to claim 1, wherein the detection marks are slits elongate in a width direction of the detection belt, which are formed through a thickness of the detection belt.

10. The recording apparatus according to claim 9, wherein the detecting device includes a light emitting element which emits light, and a light receiving element which receives the light emitted from the light emitting element, and the light emitting element and the light receiving element are opposed to each other with a clearance therebetween, in order to detect the detection marks in the detection belt while the detection belt travels through the clearance.

11. The recording apparatus according to claim 1, further comprising at least one guide which is disposed on the upstream side of the detecting device with respect to the path of circulation of the detection belt, in order to guide the detection belt to the detecting device.

12. The recording apparatus according to claim 1, wherein the detection belt is made of a material having a modulus of elasticity larger than that of the feeder belt.

* * * * *